United States Patent [19]

Watson

[11] 4,427,065

[45] Jan. 24, 1984

[54] CEMENTING PLUG CONTAINER AND METHOD OF USE THEREOF

[75] Inventor: James S. Watson, Longview, Tex.

[73] Assignee: Razorback Oil Tools, Inc., Carthage, Tex.

[21] Appl. No.: 276,263

[22] Filed: Jun. 23, 1981

[51] Int. Cl.[3] ..... E21B 33/16

[52] U.S. Cl. ..... 166/250; 166/70; 166/113; 166/291; 116/282

[58] Field of Search ..... 166/64, 65 R, 66, 90, 166/113, 153, 156, 250, 264, 291; 116/202, 282, 283; 137/268, 553, 554; 15/104.05, 104.06 A, 104.06 B; 221/90

[56] References Cited

U.S. PATENT DOCUMENTS

| | | | |
|---|---|---|---|
| 1,718,674 | 6/1929 | Wheeler | 116/283 |
| 2,533,888 | 12/1950 | Kahn | 137/268 X |
| 2,615,519 | 10/1952 | Carr | 166/70 |
| 2,652,851 | 9/1953 | Schmidt et al. | 137/553 X |
| 3,322,197 | 5/1967 | Baker et al. | 137/268 X |
| 3,545,540 | 12/1970 | Waldron | 166/70 |
| 4,317,486 | 3/1982 | Harris | 166/70 X |
| 4,336,822 | 6/1982 | Carrell | 137/268 |

*Primary Examiner*—Stephen J. Novosad
*Assistant Examiner*—Joseph Falk
*Attorney, Agent, or Firm*—John M. Harrison

[57] ABSTRACT

A cementing plug container for enclosing and injecting cementing plugs into the casing of an oil or gas well to reduce contamination on the interface between the well fluid and the cement, which container includes a shaped housing containing one or more plugs, a plug release mechanism for each plug, which release mechanism is characterized by an air cylinder and a cooperating plug support and release assembly which function to drop the plug or plugs from an upper interior segment of the housing into a lower interior segment or bore responsive to operation of the cylinder. Passage of the plug or plugs from the upper segment of the housing and through the cementing plug container assembly bore is noted by a plug pass indicator which is characterized by a rotatably-mounted wheel positioned in the interior of the housing and partially in the path of the plug, and a rack and gear mechanically coupled to the rotating wheel and designed to indicate when each cementing plug has contacted the wheel and moved through the bore of the assembly.

19 Claims, 13 Drawing Figures

CEMENTING PLUG CONTAINER AND METHOD OF USE THEREOF

BACKGROUND OF THE INVENTION

1. Field of the Invention

This invention relates to the cementing of casing in oil and gas wells by use of cementing plugs. More specifically, the invention relates to the injection of cementing plugs into casing which is hung in a well prior to the cementing operation, and to displacement of cement from the casing after the cementing process has been completed. The cementing plug container assembly of this invention is designed to release a bottom cementing plug as an interface between the drilling fluid and the cement. The bottom cementing plug wipes the drilling fluid from the walls of the casing ahead of the cement slurry, reducing dilution. At completion of mixing of the cement, the cementing plug container drops a top cementing plug on command. The function of this plug is to follow cement and prevent contamination or channeling with the drilling fluid, or fluid used to displace the cement. The cementing plug container injects the bottom and top cementing plugs from the assembly housing into the casing at specified time intervals by operation of pneumatically controlled air cylinders and plug-release mechanisms cooperating with the air cylinders. The apparatus of this invention is further characterized by a plug pass indicator which positively indicates when a plug or plugs have passed from the interior of the cementing plug container assembly housing through the bore of the housing. The cementing plug container assembly is specifically designed to quickly, efficiently and inexpensively inject one or more cementing plugs into a length of casing in an oil or gas well before and after the casing cementing operation to minimize the time and cost of cementing the casing in the well and maximize safety during the cementing operation.

2. Description of the Prior Art

Oil and gas well cementing operations have long been achieved by the use of a cementing plug container assembly which is typically designed to contain a single cementing plug for injection into the casing of the well prior to injecting cement into the casing and to displace the cement after cement is forced through it to cement the casing in the well. In most prior art operations a first plug is initially inserted in the cementing plug container assembly by removing the dome, or top of the assembly, placing the plug in the assembly housing and then replacing the dome. After the loading operation is completed the plug is forced downwardly from the cementing plug container and through the casing by pumping cement into the casing on top of the plug, and the cement is forced through the casing and upwardly around the outside wall of the casing in the annulus between the well bore and the casing to secure the casing in position in the well. Subsequently, the dome is again removed and a second cementing plug is placed in the assembly housing and forced through the casing to clear the casing of residual cement. In some operations it may not be necessary to use a bottom cementing plug, and under these conditions a single top cementing plug is used.

It will be recognized by those skilled in the art that this procedure of removing the dome, placing cementing plugs inside the cementing plug container and subsequently replacing the dome in the sequence described above is expensive, constitutes a safey hazard, and is time-consuming. Accordingly, this operation adds time and expense to the cost of cementing and completing wells in oil and gas field operations, and has been known to create accidents. Furthermore, it is sometimes difficult to determine whether or not the plug or plugs have actually been forced from the cementing plug container into the casing, since no positive indicating mechanism is generally available to make this determination. Accordingly, it is frequently necessary to remove the dome from the assembly housing in order to be sure that each cementing plug has been forced from the cementing plug container assembly and into the casing.

Accordingly, it is an object of this invention to provide a new, improved and safer cementing plug container assembly which is characterized by at least one plug release mechanism which may be automatic in function, and serves to release one or more plugs in the assembly for injection into the well casing in a positive and efficient manner without the necessity of removing the dome from the assembly.

Another object of this invention is to provide a cementing plug container which is characterized by a plug pass indicator positioned beneath the plug release mechanism and having an internal wheel which is contacted by the cementing plug or plugs as they pass sequentially through the housing to positively indicate when the plugs have passed from the housing and through the cementing plug container assembly bore.

Yet another object of the invention is to provide a new and improved cementing plug container which is equipped with a plug release mechanism for supporting and releasing one or more cementing plugs, which mechanism is characterized by a separate air cylinder and cooperating release assembly or mechanism for releasing each plug in a specified and controlled sequence by pneumatic extension of the air cylinder piston; and a plug pass indicator device which is positioned beneath the plug release mechanism or mechanisms, and includes a star wheel rotatably disposed in the interior of the assembly housing for engagement with the cementing plug or plugs as they pass through the housing bore, and rotation responsive to this engagement to initiate movement of an indicator gear rack located externally of the cementing plug container assembly bore in order to positively indicate when a cementing plug has moved from the interior of the housing and through the bore of the housing.

A still further object of this invention is to provide a new and improved plug release mechanism for supporting and releasing one or more cementing plugs in a cementing plug container apparatus for cementing casing in oil and gas wells, which release mechanism includes a support arm carrying the plug and attached to a release shaft, which is in turn carried by a release cam for maintaining the release arm in supporting configuration; the release cam further cooperating with an air cylinder designed to permit downward rotation of the release arm by extension of the air cylinder piston and allow the cementing plug to drop from the upper interior portion of the assembly housing into the bore of the housing for injection into the casing.

Another object of the invention is to provide a positive and efficient indicator mechanism for determining when one or more cementing plugs have moved from the upper segment of the cementing plug container housing and through the bore of the housing, which indicator includes a wheel rotatably positioned in the bore of the housing and having teeth which extend into the path of the plug or plugs, and a shaft carrying the wheel and extending through the housing to cooperate with a rack which is slidably mounted on the exterior of the housing and is movable upon rotation of the wheel responsive to contact between the wheel and a falling cementing plug in the cementing plug container assembly housing bore.

SUMMARY OF THE INVENTION

These and other objects of the invention are provided in a new and improved cementing plug container assembly for injecting cement into the casing of an oil or gas well, which assembly includes a plug release mechanism for each cementing plug designed to support and selectively release a plug or plugs in the housing, and further including a plug release arm in contact with each cementing plug and normally supporting the plug in an upper segment of the housing; a shaft carrying the support arm at one end and extending through the housing in attachment to a release cam at the opposite end; and a cam lock mechanism in cooperation with an air cylinder and the release cam, whereby activation of the air cylinder effects linear movement of the cam lock mechanism and rotation of the release cam and the support arm to permit each cementing plug to drop from its position in the upper part of the assembly housing into the housing bore for injection into the casing. A plug pass indicator assembly which includes a rotating wheel positioned inside the cementing plug container assembly housing bore and beneath the plug release mechanism or mechanisms, which wheel is carried by a shaft extending through the housing and cooperating with a rack and gear mechanism for advancing the rack upon rotation of the wheel responsive to movement of a cementing plug through the housing and contacting the wheel as the plug moves through the cementing plug container bore.

BRIEF DESCRIPTION OF THE DRAWINGS

The invention will be better understood by reference to the accompanying drawings wherein.

DESCRIPTION OF THE PREFERRED EMBODIMENTS

Figure 1:
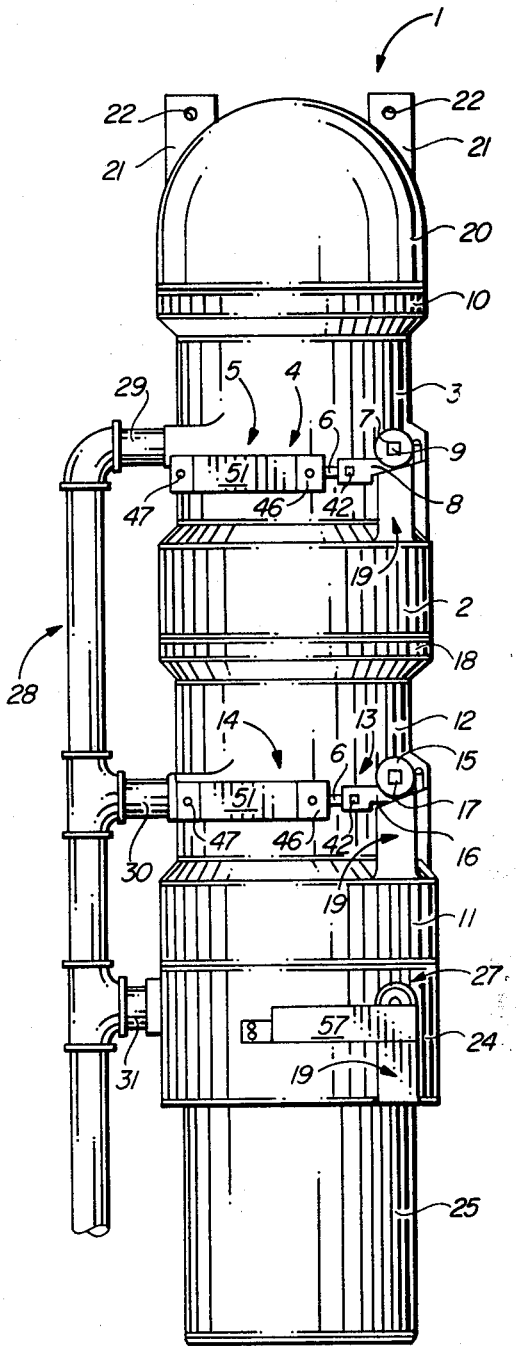
FIG. 1 is a front elevation of a preferred embodiment of the cementing plug container of this invention, more particularly illustrating the exterior component parts of the plug release and plug pass indicator mechanisms.
Figure 2:
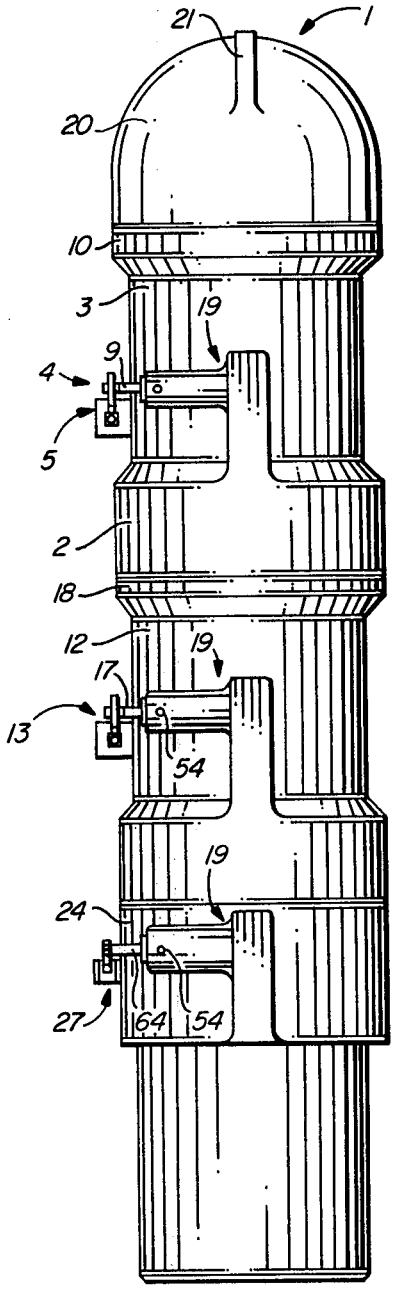
FIG. 2 is a right side elevation of the cementing plug container illustrated in FIG. 1.

Referring now to FIGS. 1 and 2 of the drawings in a preferred embodiment the cementing plug container assembly of this invention is generally illustrated by reference numeral 1 and includes a dome 20, an upper housing 2 and lower housing 11, and a saver sub 24. Upper housing 2 further includes a top plug chamber 3 and a bottom plug chamber 12 to accommodate a pair of cementing plugs in the hollow interior of cementing plug container assembly 1, as hereinafter described. Dome 20 is provided with a pair of dome flanges 21, fitted with flange apertures 22 for lifting purposes. A manifold assembly 28 is fitted with a top plug chamber inlet 29, for introducing cement into top plug chamber 3; a bottom plug chamber inlet 30, for communicating with bottom plug chamber 12; and a saver sub inlet 31 for introducing fluid into the interior of saver sub 24.

A top plug release is generally illustrated by reference numeral 4, and the external component parts of top plug release 4 are mounted on a top shaft housing 19 in upper housing 2, as illustrated in FIG. 2. Among the exterior component parts of the top plug release 4 is the top air cylinder 5, which is characterized by an air cylinder piston housing 51 having a front base 46 and a rear base 47, as illustrated. The air cylinder piston rod 6 of top air cylinder 5 cooperates with a top cam lock 8 to slide the top cam lock 8 forward with respect to a cam lock release pin 42, and release top plug release cam 7, as hereinafter described. A bottom plug release is generally illustrated by reference numeral 13, and is positioned beneath top plug release 4 on lower housing 11. A bottom air cylinder 14, also having a front base 46 and a rear base 47 connected by an air cylinder piston housing 51, is provided in cooperation with a bottom cam lock 16 and a cooperating bottom plug release cam 15. Accordingly, activation of bottom air cylinder 14 releases bottom cam lock 16 from a bottom plug release cam 15, and allows a bottom cementing plug to drop from bottom plug chamber 12 into the cementing plug container assembly bore, as hereinafter described.

As further illustrated in FIGS. 1 and 2 of the drawings a plug pass indicator is generally illustrated by reference numeral 27, and is positioned beneath top plug release 4 and bottom plug release 13. In a preferred embodiment of the invention the plug pass indicator 27 is mounted to the saver sub 24 and is designed to indicate when one or more plugs located in the interior of upper housing 2 and lower housing 11 are released from the top plug release 4 or bottom plug release 13. The well pipe connector 25 extending from saver sub 24 is designed to be threaded and to attach to substantially any well pipe in an existing oil or gas well.

Figure 3:
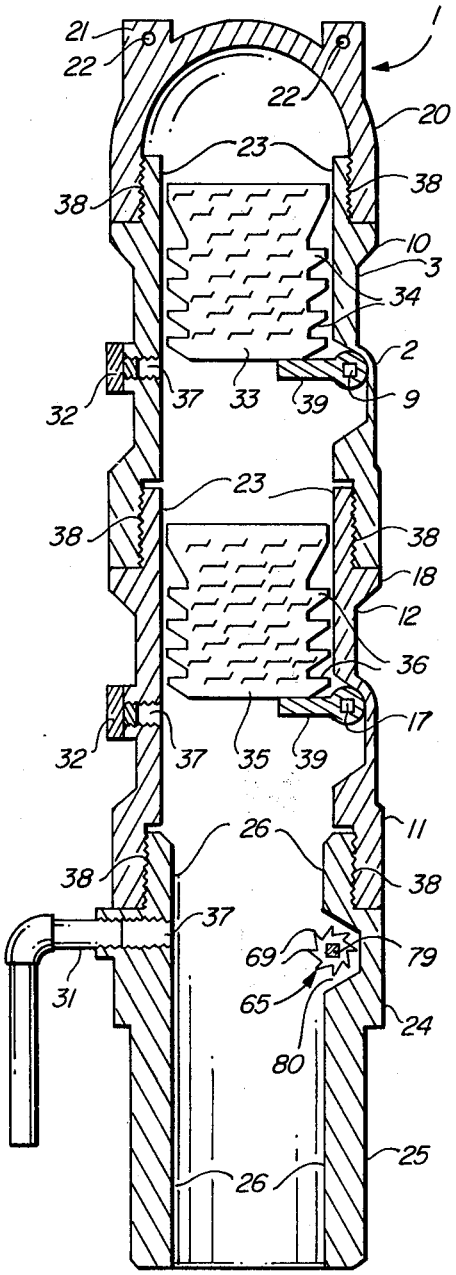
FIG. 3 is a front sectional view of the cementing plug container assembly illustrated in FIG. 1 with the top and middle inlet apertues plugged.

Referring now to FIG. 3 of the drawings the cementing plug container assembly 1 is further characterized by a hollow interior having a plug chamber bore 23 which defines the interior of top plug chamber 3 and bottom plug chamber 12, respectively. In a preferred embodiment of the invention the dome 20 is threadably attached to top plug chamber 3 by means of housing threads 38, and rests on upper housing shoulder 10 of upper housing 2. Similarly, upper housing 2 is attached to lower housing 11, resting on lower housing shoulder 18, and lower housing 11 is in turn connected to saver sub 24, respectively, by means of additional housing threads 38. In the event one or more of the inlet apertures 37 must be closed, it will be recognized that inlet aperture caps or plugs 32 can be threadably inserted therein to effect the desired closure, as illustrated.

Referring again to FIGS. 1, 2 and 3, it will be appreciated that top plug release shaft 9 of top plug release 4, and bottom plug release shaft 17 of bottom plug release 13, each extend through a shaft housing 19, respectively, and carry a plug release arm 39, disposed in top plug chamber 3 and bottom plug chamber 12, respectively. Accordingly, as hereinafter more particularly described, when top air cylinder 5 and bottom air cylinder 14 are activated in the proper sequence the plug release arms 39 are caused to rotate downwardly and release the top plug 33 and the bottom plug 35, respectively, resting on plug release arms 39, at the desired time. Top plug 33 and bottom plug 35 then drop into saver sub bore 26, which is smaller in diameter than plug chamber bore 23 and the projecting top plug ribs 34 and bottom plug ribs 36, respectively. Accordingly, both top plug 33 and bottom plug 35 remain in contact with the top portion of saver sub bore 26 until they are forced through the bore and into the casing by cement or other fluid pressure.

Referring again to the plug pass indicator 27 as illustrated in FIGS. 1 and 2, and to FIG. 3, it will be appreciated that the internally mounted star wheel, which is generally illustrated by reference numeral 65, cooperates with the external component parts of plug pass indicator 27 to indicate when the top plug 33 and bottom plug 35 move sequentially through saver sub bore 26, and into the casing responsive to fluid pressure. Accordingly, as the top plug ribs 34 and bottom plug ribs 36 traverse saver sub bore 26 they contact the star wheel teeth 69 of star wheel 65 and cause star wheel 65 to rotate 360 degrees. This rotation of star wheel 65 indicates the passage of both top plug 33 and bottom plug 35 through saver sub bore 26, respectively, as hereinafter described.

Figure 4:
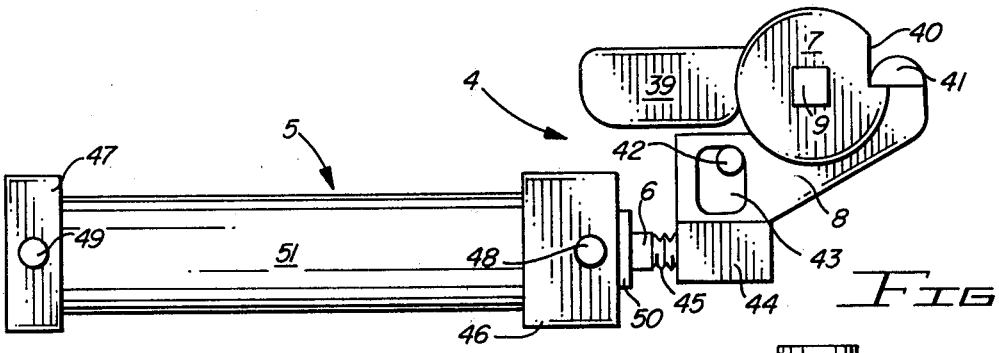
FIG. 4 is a front elevation of the plug release mechanism illustrated in FIG. 1.
Figure 5:
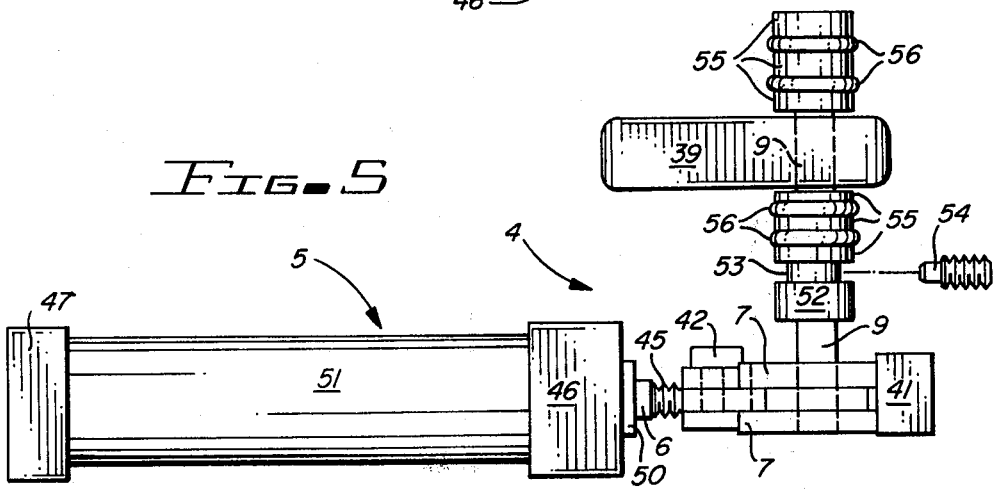
FIG. 5 is a top elevation of the plug release mechanism illustrated in FIG. 4.
Figure 6:
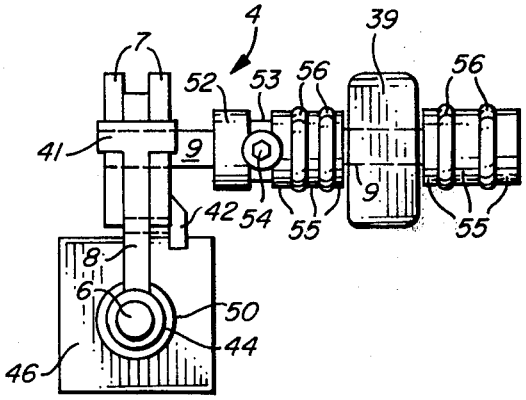
FIG. 6 is a right end elevation of the plug release mechanism illustrated in FIGS. 4 and 5.

Referring again to FIGS. 1–3, and also to FIGS. 4, 5 and 6 of the drawings, the latter of which figures illustrate the top plug release 4 in detail, it will be appreciated that top plug release 4 and bottom plug release 13 are identical in mechanical configuration and function. Referring specifically to FIGS. 5 and 6, as heretofore described, the top plug release shaft 9, which carries top plug release cam 7, rotatably extends through a shaft housing 19 with the plug release arm 39 projecting through upper housing 2 and into top plug chamber 3. Accordingly, the top air cylinder 5, and its cooperating air cylinder piston rod 6, provided with piston rod threads 45; piston seal 50, as well as the top plug release cam 7; the top cam lock 8 and cooperating cam lock finger 41; and the cam lock base 44, to which the air cylinder piston rod 6 is threadably secured, are all positioned outside of upper housing 2. Furthermore, the O-ring shoulders 55, which contain O-rings 56, and the end of top plug release shaft 9 opposite the top plug release cam 7, extend inside shaft housing 19, with set screw 54 threadably inserted in the wall of shaft housing 19 and engaging set screw release groove 53 in release shaft collar 52, to secure the O-ring shoulders 55 and the O-rings 56 in rotatable relationship in shaft housing 19. Accordingly, it will be appreciated that since top plug release shaft 9 is secured to top plug release cam 7 at one end and since O-ring shoulders 55 are rotatably secured inside shaft housing 19, plug release arm 39 is free to rotate with top plug release shaft 9 upon rotation of plug release cam 7. Referring now to FIG. 4, it will be further appreciated that top air cylinder 5 can be activated by injecting air into air cylinder piston housing 51 through rear base air aperture 49 in rear base 47, and expulsion of air from front base air aperture 48 in front base 46, to extend air cylinder piston rod 6 and slidably displace top cam lock 8 on cam lock release pin 42 due to the width of cam lock aperture 43 provided in top cam lock 8. This forward motion of top cam lock 8 with respect to cam lock release pin 42 disengages cam lock finger 41 from cam slot 40, provided in top plug release cam 7. Further extension of air cylinder piston rod 6 exerts pressure on cam lock release pin 42, which is attached to top plug release cam 7, and causes top plug release cam 7 and plug release arm 39 to rotate in the counter-clockwise direction. This rotation of plug release arm 39 allows top plug 33 to fall from its position inside the top plug chamber 3 to saver sub bore 26. It will be appreciated that prior to activation of top plug release 4, bottom plug 35 would have been previously released from its position on the bottom plug release arm 39 responsive to activation of bottom air cylinder 14, in the manner described above. Air cylinder piston rod 6 is retracted by reducing the air pressure to rear base air aperture 49 and allowing the spring-loaded top air cylinder 5 to retract into the configuration illustrated in FIGS. 4 and 5.

Figure 8:
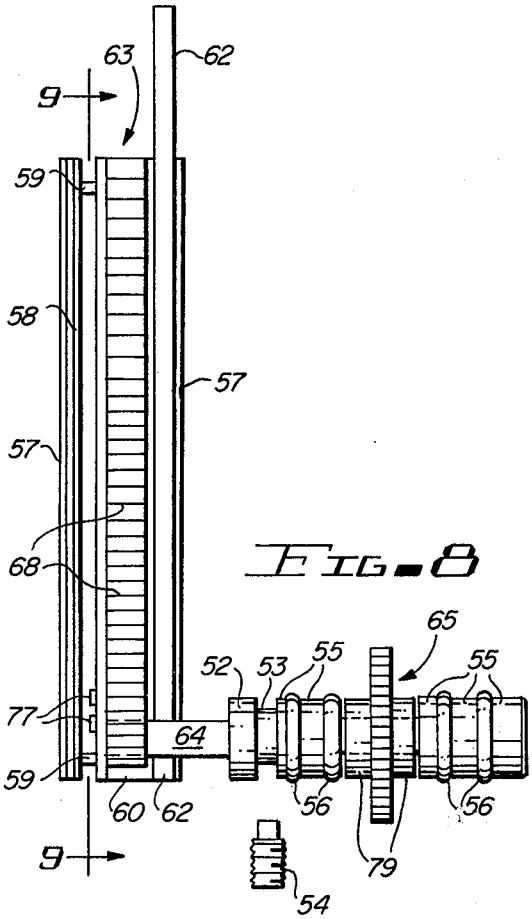
FIG. 8 is a top elevation of the plug pass indicator illustrated in FIG. 7.
Figure 9:
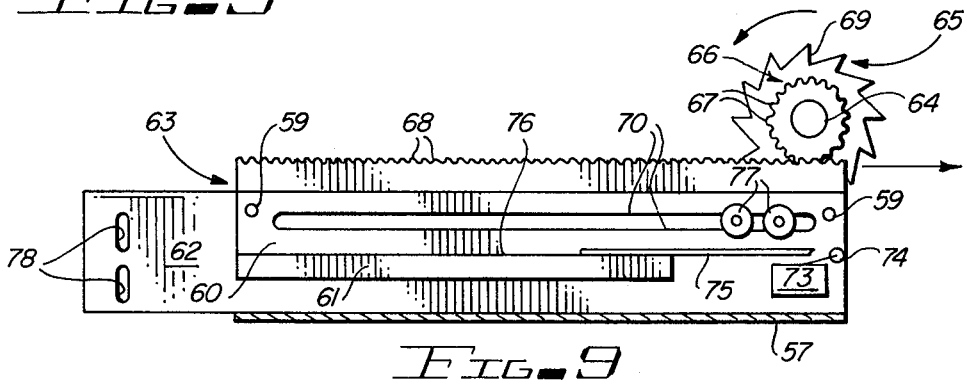
FIG. 9 is a left side elevation of the plug pass indicator illustrated in FIGS. 7 and 8, partially in section, taken along line 9—9 in FIG. 8.
Figure 7:
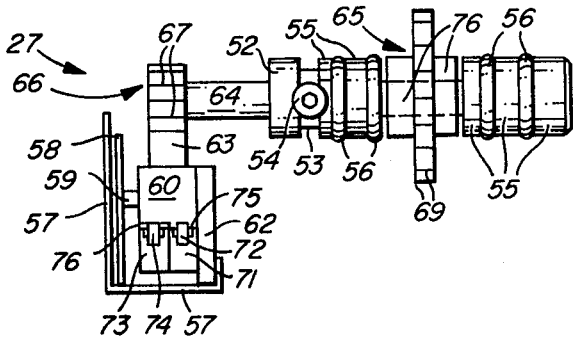
FIG. 7 is a right end elevation of the plug pass indicator illustrated in FIG. 2.

Referring again to FIGS. 1–3, and also to FIGS. 7, 8 and 9, the plug pass indicator 27 is designed to register the sequential passage of top plug 33 and bottom plug 35 through saver sub bore 26. As illustrated in FIGS. 7 and 8, among the component parts of plug pass indicator 27 which are located on the exterior of saver sub 24 are the indicator gear 66, fitted with indicator gear teeth 67, which mesh with the indicator gear rack teeth 68 of a slidably-positioned indicator gear rack 63. Indicator gear rack 63 is fixedly attached to an indicator mount bar 60, which is provided with a guide slot 70, and carries an indicator plate 58 by means of a pair of indicator plate mounts 59. An indicator mount plate 62 is provided with a pair of mount plate apertures 78, for securing the mount plate to the saver sub 24. Indicator mount plate 62 also carries an indicator guide bar 61 in fixed relationship, with a pair of guide pins 77, extending from attachment to indicator mount plate 62 through guide slot 70 in indicator mount bar 60, in order to secure indicator gear rack 63 and indicator mount bar 60 to indicator guide bar 61 and indicator mount plate 62 in slidable relationship. An indicator cover 57 is also mounted in fixed relationship on indicator mount plate 62 and completely covers the indicator plate 58 when the indicator gear rack 63 is in retracted position as illustrated in FIGS. 8 and 9. Referring again to FIGS. 7 and 8, one end of star wheel shaft 64 is secured to indicator gear 66, and the opposite segment of star wheel shaft 64 carries a release shaft collar 52, O-ring shoulders 55 with accompanying O-rings 56, and star wheel mount 79, to which star wheel 65 is secured. It will be further appreciated from a consideration of FIGS. 7 and 8 and FIG. 2 of the drawings that the release shaft collar 52; O-ring shoulders 55; and O-rings 56 are maintained in a shaft housing 19 of saver sub 24 by means of a set screw 54, with star wheel 65 and star wheel mount 79 positioned in rotatable relationship in bore cavity 80 of saver sub bore 26. Accordingly, since star wheel 65 and star wheel mount 79 are mounted in fixed relationship on star wheel shaft 64, and since indicator gear 66 is also mounted in fixed relationship on star wheel shaft 64, rotation of star wheel 65 responsive to sequential engagement of the star wheel teeth 69 with the bottom plug ribs 36 of bottom plug 35, and the top plug ribs 34 of top rib 33, causes rotation of star wheel 65 and indicator gear 66. This rotation of star wheel 65 effects an extension of indicator gear rack 63 forwardly, as indicated by the arrow in FIG. 9. The extension of gear rack 63 also extends the indicator plate 58 from its alignment with the indicator cover 57, to positively show that a plug has passed through saver sub bore 26.

Referring again to FIGS. 7 and 9 of the drawings in a most preferred embodiment of the invention a bottom plug micro-switch 71 and a top plug micro-switch 73 are mounted in side-by-side relationship on indicator mount plate 62. Bottom plug micro-switch 71 is provided with a bottom plug micro-switch roller 72, which engages a bottom plug roller surface 75, provided on indicator mount bar 60, as illustrated. Similarly, top plug micro-switch 73 is provided with a top plug micro-switch roller 74, which engages a top plug micro-switch roller surface 76, also provided in indicator mount bar 60. As illustrated in FIG. 7, when indicator gear rack 63 and the cooperating indicator mount bar 60 begin to extend responsive to the rotation of star wheel 65, bottom plug micro-switch roller 72 contacts bottom plug roller surface 75 and activates bottom plug micro-switch 71, which in turn illuminates a light on a central control panel (not illustrated) to indicate that bottom plug 35 has been dropped from bottom plug chamber 12 by operation of bottom plug release 13, and has moved through saver sub bore 26. Similarly, when indicator gear rack 63 and indicator mount bar 60 are further extended by operation of star wheel 65 and indicator gear 66 responsive to the passage of top plug 33 through saver sub bore 26, top plug micro-switch roller 74 engages top plug roller surface 76 on indicator mount bar 60, to energize top plug micro-switch 73, and illuminate a second light on the control panel.

Figure 10:
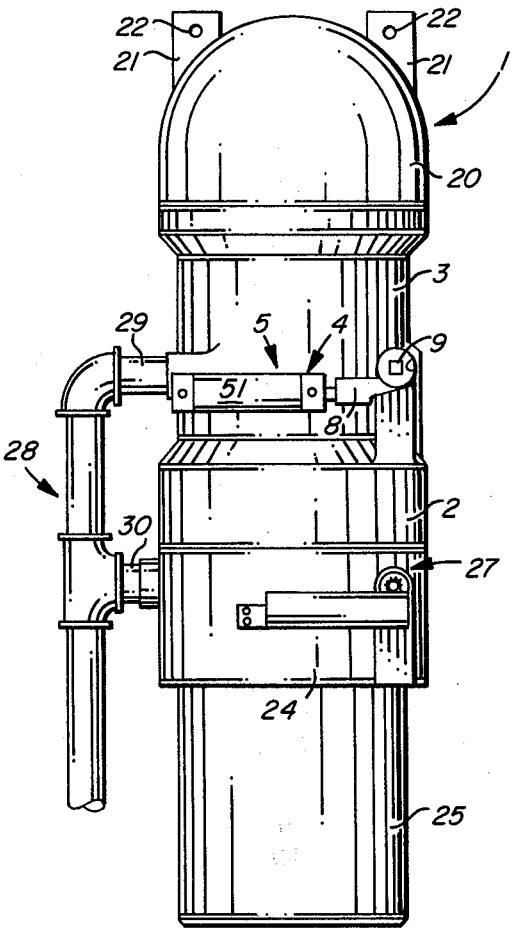
FIG. 10 is a front elevation of an alternative embodiment of the cementing plug container assembly of this invention.
Figure 11:
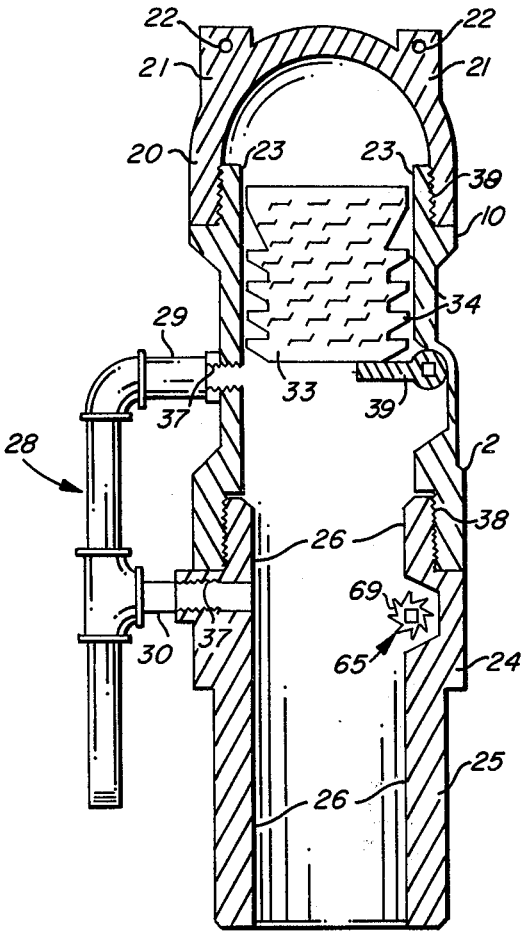
FIG. 11 is a front sectional view of the cementing plug container assembly illustrated in FIG. 10.

Referring now to FIGS. 10 and 11 of the drawings in an alternative preferred embodiment of the invention the cementing plug container assembly 1 consists of a dome 20, threadably secured to an upper housing 2 by means of housing threads 38, and a saver sub 24, also connected by means of housing threads 38 directly to upper housing 2. In this embodiment of the invention the lower housing 11, illustrated in FIGS. 1 and 2, is eliminated under circumstances where a single top plug 33 is provided in the cementing plug container assembly 1 and is used to clean cement residue from the well casing. A plug pass indicator 27 is provided in saver sub 24 as described above, with a star wheel 65 located in bore cavity 80 as illustrated, in order to indicate the passage of top plug 33 through saver sub bore 26, as heretofore described.

Figure 12:
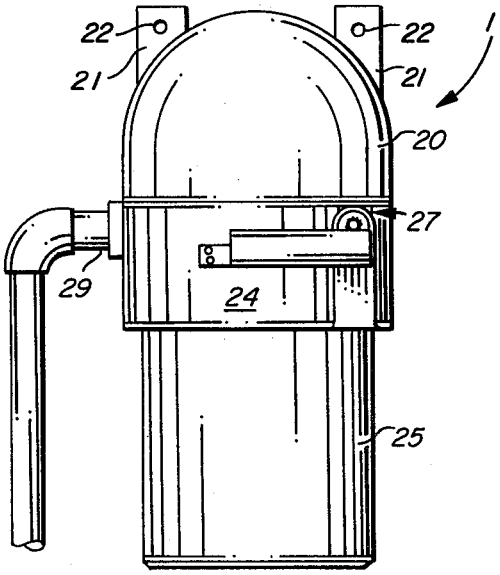
FIG. 12 is a front elevation of yet another embodiment of the cementing plug container assembly of this invention.
Figure 13:
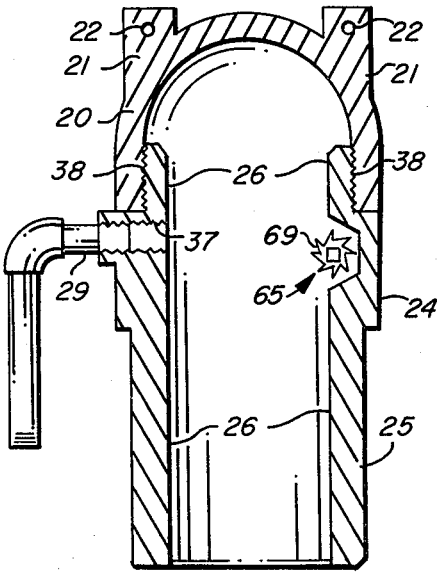
FIG. 13 is a front sectional view of the cementing plug container assembly illustrated in FIG. 12.

Referring to FIGS. 12 and 13, in a still further preferred embodiment of the invention the dome 20 can be directly and threadably attached to saver sub 24 by means of housing threads 38, with a plug pass indicator 27 provided in saver sub 24, as heretofore described. In this embodiment of the invention no cementing plugs are inserted inside dome 20, and the cementing plug container assembly is simply used to inject fluids into the well, as desired. In this embodiment of the invention the plug pass indicator 27 serves no useful function, but is provided in the saver sub 24 simply to demonstrate the versatility of interchangeable parts in the invention.

In operation, and referring again to FIGS. 1–3 of the drawings, under circumstances where the cementing plug container assembly 1 is characterized by a dome 20, an upper housing 2, a lower housing 11 and a saver sub 24, the assembly can be used to inject a pair of cementing plugs into the well casing as follows. The well pipe connector 25 is initially threaded and prepared to connect to an existing oil or gas well according to procedures known to those skilled in the art. After the cementing plug container assembly 1 has been connected to the well head air lines are attached to top air cylinder 5 and bottom air cylinder 14, and are connected to a control panel and an air supply source according to the knowledge of those skilled in the art. Dome 20 is then removed from upper housing 2, the upper plug release arm 39 is rotated downwardly by activation of top air cylinder 5, and bottom plug 35 is inserted in bottom plug chamber 12 of lower housing 11 as illustrated in FIG. 3. Subsequently, the upper plug release arm 39 is rotated upwardly and top plug 33 is inserted in top plug chamber 3 of upper housing 2 and is also supported by a plug release arm 39. Dome 20 is then threadably replaced on upper housing 2 and is secured tightly against upper housing shoulder 10 and the cementing plug container assembly 1 is ready for operation. Alternatively, the cementing plug container assembly 1 can be pre-loaded with top plug 33 and bottom plug 35, as desired. When it is desired to begin pumping cement through cementing plug container assembly 1 and into the well casing, the bottom plug release 13 is activated by introducing air under pressure to rear base air aperture 49 of bottom air cylinder 14, which extends the air cylinder piston rod 6. This action also extends bottom cam lock 16 and cam lock finger 41, which are attached to air cylinder piston rod 6, as illustrated in FIGS. 4–6, to release cam lock finger 41 from cam slot 40 of bottom plug release cam 15. Bottom plug release cam 15 and plug release arm 39 then rotate in a counter-clockwise direction responsive to further extension of air cylinder piston rod 6, causing bottom plug 35 to drop into the mouth of saver sub bore 26, where bottom plug ribs 36 of bottom plug 35 contact saver sub bore 26 and prevent bottom plug 35 from moving further downwardly into the bore. Cement is then pumped through manifold assembly 28 and into bottom plug chamber 12 through bottom plug chamber inlet 30 and the pressure of the cement forces bottom plug 35 through saver sub bore 26 and the well casing to precede the cement into the casing. The cement is pumped through the casing and into the annulus between the outside casing wall and the well bore to cement the casing in the well bore. When it is desired to displace the casing of residual cement, top plug release 4 is operated by activating top air cylinder 5 to extend air cylinder piston rod 6 and release top plug release cam 7 from cam lock finger 41, as heretofore described with regard to bottom plug release 13. Further extension of air cylinder piston rod 6 causes top plug release cam 7 to rotate in the counter-clockwise direction and moves the upper plug release arm 39 downwardly, causing top plug 33 to fall into the mouth of saver sub bore 26. A displacing fluid is then introduced into manifold assembly 28, and flows through top plug chamber inlet 29 and into top plug chamber 3; alternatively, the displacing fluid can be introduced through bottom plug chamber inlet 30 and into bottom plug chamber 12 to force top plug 33 through saver sub bore 26 and the well casing.

Referring again to FIGS. 1–3 and 7–9, as heretofore described, it will be appreciated that when both top plug 33 and bottom plug 35 move sequentially through saver sub bore 26 the top plug ribs 34 of top plug 33, and the bottom plug ribs 36 of bottom plug 35 must contact star wheel teeth 69 of star wheel 65, and cause star wheel 65 to rotate in the counter-clockwise direction. Accordingly, when bottom plug 35 moves through saver sub bore 26 responsive to the pressure of the concrete being pumped into cementing plug container assembly 1, the rotation of star wheel 65 effects a complimentary rotation of indicator gear 66, which in turn causes an extension of indicator gear rack 63 and indicator mount bar 60 in the direction of the arrow, as shown in FIG. 9. In a preferred embodiment of the invention star wheel 65 is sized such that a 360 degree rotation of star wheel 65 will effect an extension of one-half of the length of indicator gear rack 63. Under these circumstances indicator plate 58, which is attached to indicator gear rack 63 and indicator mount bar 60, also extends past indicator cover 57 for a distance equal to one-half of its length. As this first one-half of the length of indicator plate 58 is color-coded, then extension of this portion of indicator plate 58 past indicator cover 57 shows that bottom plug 35 has indeed been forced through saver sub bore 26 and into the well casing. Accordingly, when top plug 33 is forced through saver sub bore 26 and into the well casing, the star wheel 65 turns an additional 360 degrees, thereby fully extending indicator gear rack 63 and indicator mount bar 60 as well as indicator plate 58, to present a second color in the color coding sequence, which verifies that top plug 33 has also exited the interior of the cementing plug container assembly 1 and has been forced through saver sub bore 26. As heretofore described, an additional indication of passage of top plug 33 and bottom plug 35 through saver sub bore 26 is the lights mounted on the central control panel and electrically connected to bottom plug micro-switch 71 and top plug micro-switch 73, under circumstances where such micro-switches are used in the invention.

Referring again to FIG. 1 of the drawings, it is understood that top plug release 4 and bottom plug release 13 can be manually manipulated by grasping top cam lock 8 and bottom can lock 16 and forcing top cam lock 8 and bottom cam lock 16 against cam lock release pins 42, respectively, to sequentially release bottom plug 35 and top plug 33.

It is understood that while the upper housing, lower housing, dome, saver sub and well pipe connector can be fabricated of substantially any material, aluminum is a preferred material of construction in order to reduce weight and enhance portability of the cementing plug container.

It will be further appreciated that the cementing plug container assembly of this invention is characterized by utility, convenience and efficiency, since it can be manually or remotely operated, using one or more cementing plugs, interchangeable housing parts, and an appropriate control system utilizing compressed air as the source of power for the plug release mechanism or mechanisms. In this regard, in a most preferred embodiment of the invention, and referring again to the drawings, the control system for the top plug release 4, and the bottom plug release 13, as well as the indicator lights showing passage of top plug 33 and bottom plug 35 through saver sub bore 26 are mounted on a control board for ease of monitoring and manipulation.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A cementing plug container for cementing casing in a well comprising:

(a) a housing having a hollow interior and a connector means on one end for attachment to the well, and further including at least one conduit means for introducing cement into said hollow interior of said housing;

(b) at least one plug release means carried by said housing and further characterized by a cam lock having a projecting finger and provided with a cam lock aperture; a release cam having a cam slot for engagement with said projecting finger of said cam lock and a cam lock release pin in registration with said cam lock aperture; a release shaft having one end fixably carried by said release cam and extending through said housing and into said hollow interior; a release arm fixedly attached to the end of said release shaft opposite said one end and positioned in said hollow interior of said housing for supporting a cementing plug; and manipulating means cooperating with said cam lock whereby said cam lock is selectively moved outwardly against said lock release pin to first disengage said projecting finger from said cam slot and then displace said lock release pin and rotate said release cam, said release shaft and said release arm to allow a cementing plug to drop from a first position to a second position in said hollow interior; and (c) plug pass indicator means carried by said housing and positioned beneath said plug release means, said plug pass indicator means extending through said housing for contact with a cementing plug when the cementing plug is released by said plug release means, and indicating when the cementing plug has moved from the second position to a position below said plug pass indicator means.

2. The cementing plug container of claim 1 wherein said at least one plug release means is a first plug release means for supporting a first cementing plug and a second plug release means for supporting a second cementing plug, said first plug release means and said second plug release means mounted in stacked relationship in said housing.

3. The cementing plug container of claim 1 wherein said conduit means is further characterized by a first discharge conduit connecting with said hollow interior of said housing near said at least one plug release means, and a second discharge conduit connecting with said hollow interior of said housing near said plug pass indicator means.

4. The cementing plug container of claim 1 wherein:

(a) said at least one plug release means is a first plug release means for supporting a first cementing plug and a second plug release means for supporting a second cementing plug, said first plug release means and said second plug release means mounted in stacked relationship in said housing; and (b) said conduit means is further characterized by a first discharge conduit connecting with said housing near said first plug release means; a second discharge conduit connecting with said housing near said second plug release means; and a third discharge conduit connecting with said housing near said plug pass indicator means.

5. The cementing plug container of claim 1 wherein said plug pass indicator means is further characterized by a wheel shaft rotatably mounted in said housing and having one end projecting outside of said housing and the opposite end extending into said hollow interior of said housing; a gear fixedly attached to said one end of said wheel shaft; a mount plate fixedly carried by said housing and a guide fixedly attached to said mount plate; a mount bar slidably carried by said mount plate and supported by said guide in slidable relationship; a rack cooperating with said gear and fixedly carried by said mount bar whereby rotation of said wheel shaft and said gear causes extension of said rack and said mount bar with respect to said mount plate, said guide and said housing; and a wheel fixedly attached to said opposite end of said wheel shaft for engagement with a cementing plug, released by said plug release means and rotation of said wheel shaft and said gear to extend said rack.

6. The cementing plug container of claim 2 wherein:

(a) said conduit means is further characterized by a first discharge conduit connecting with said housing near said first plug release means; a second discharge conduit connecting with said housing near said second plug release means; and a third discharge conduit connecting with said housing near said plug pass indicator means; and, (b) said plug pass indicator means is further characterized by a wheel shaft rotatably mounted in said housing and having one end projecting outside of said housing and the opposite end extending into said hollow interior of said housing; a gear fixedly attached to said one end of said wheel shaft; a mount plate fixedly carried by said housing and a guide fixedly attached to said mount plate; a mount bar slidably carried by said mount plate and supported by said guide in slidably relationship; a rack cooperating with said gear and fixedly carried by said mount bar whereby rotation of said wheel shaft and said gear causes extension of said rack and said mount bar with respect to said mount plate, said guide and said housing; and a wheel fixedly attached to said opposite end of said wheel shaft for engagement with cementing plugs sequentially released by said first plug release means and said second plug release means, and rotation of said wheel shaft and said gear to extend said rack.

7. The cementing plug container of claim 6 further comprising separate shaft housing means provided in said housing for receiving said release shaft in said first plug release means and said second plug release means, respectively, and said wheel shaft in said plug pass indicator means.

8. The cementing plug container of claim 6 wherein said manipulating means is an air cylinder secured to said housing and having a piston rod attached to said cam lock for selectively moving said cam lock outwardly and causing the cementing plugs to sequentially drop from said first position to said second position in said hollow interior.

9. A cementing plug container assembly for injecting cement into a well casing comprising:

(a) a generally cylinderally-shaped housing having a hollow interior and a shaped connector on one end of said housing for attachment to a well for producing hydrocarbons;

(b) a first plug release mechanism mounted in a first position in said housing and a second plug release mechanism mounted in a second position in said housing beneath said first plug release mechanism, said first plug release mechanism and said second plug release mechanism further characterized by a cam lock having a projecting finger and provided with a cam lock aperture; a release cam having a cam slot for engagement with said projecting finger of said cam lock, and a cam lock release pin in registration with said cam lock aperture; a release shaft having one end fixedly carried by said release cam and extending through said housing and into said hollow interior; a release arm fixedly attached to the end of said release shaft opposite said one end and positioned in said hollow interior of said housing for supporting a cementing plug; and an air cylinder having a piston rod in engagement with said cam lock whereby said cam lock is selectively moved outwardly against said lock release pin to first disengage said projecting finger from said cam slot and then displace said lock release pin and rotate said release cam, said release shaft, and said release arm to allow the cementing plug positioned in a first position in said hollow interior and resting on said release arm, to drop from said first position to a second position on said hollow interior; and (c) a plug pass indicator cooperating with said housing and positioned beneath said second plug release mechanism, said plug pass indicator further characterized by a wheel shaft rotatably mounted in said housing and having one end projecting outside of said housing and the opposite end extending into said hollow interior of said housing; a gear fixedly attached to said one end of said wheel shaft; a mount plate fixedly carried by said housing and a guide fixedly attached to said mount plate; a mount bar slidably carried by said mount plate and supported by said guide in slidable relationship; a rack cooperating with said gear and fixedly carried by said mount bar, whereby rotation of said wheel shaft and said gear causes extension of said rack and said mount bar with respect to said mount plate, said guide and said housing; and a wheel fixedly attached to said opposite end of said wheel shaft for engagement with cementing plugs and rotation of said wheel shaft and said gear to extend said rack when cementing plugs are sequentially released from said first plug release mechanism and said second plug release mechanism.

10. The cementing plug container assembly of claim 9 wherein said hollow interior of said housing narrows near said plug pass indicator to define a bore with is diametrically smaller than the diameter of said cementing plugs.

11. A cementing plug container assembly for cementing casing in a well comprising:

(a) a housing having a hollow interior and a connector on one end for joining said housing to the well;

(b) conduit means extending through said housing and into said hollow interior for injecting concrete and fluids into said hollow interior of said housing;

(c) a first plug release means carried by said housing and extending through said housing into said hollow interior and a first cementing plug supported in said hollow interior by said first plug release means and a second plug release means carried by said housing and positioned beneath said first plug release means and extending through said housing into said hollow interior and a second cementing plug supported in said hollow interior by said second plug release means, said first plug release means and said second plug release means each further characterized by a cam lock having a projecting finger and provided with a cam lock aperture; a release cam having a cam slot for engagement with said projecting finger of said cam lock, and a cam lock release pin in registration with said cam lock aperture; a release shaft having one end fixedly carried by said release cam and extending through said housing and into said hollow interior; a release arm fixedly attached to the end of said release shaft opposite said one end and positioned in said hollow interior of said housing for supporting a cementing plug; and an air cylinder having a piston rod in engagement with said cam lock, whereby said cam lock is selectively moved outwardly against said lock release pin to first disengage said projecting finger from said cam slot and then displace said lock release pin and rotate said release cam, said release shaft, and said release arm to allow said first cementing plug and said second cementing plug to sequentially drop from a first position to a second position in said hollow interior; and (d) plug pass indicator means carried by said housing and positioned beneath said second plug release means, said plug pass indicator means including wheel means extending into said housing to contact said second cementing plug and said first cementing plug when said second cementing plug and said first cementing plug are sequentially released from said second plug release means and said first plug release means, respectively.

12. A cementing plug container assembly for cementing casing in a well comprising:

(a) a housing having a hollow interior and a connector on one end for joining said housing to the well;

(b) conduit means extending through said housing and into said hollow interior for injecting concrete and fluids into said hollow interior of said housing;

(c) a first plug release means carried by said housing and extending through said housing into said hollow interior and a first cementing plug supported in said hollow interior by said first plug release means;

(d) a second plug release means carried by said housing and positioned beneath said first plug release means and extending through said housing into said hollow interior and a second cementing plug supported in said hollow interior by said second plug release means; and (e) plug pass indicator means carried by said housing and positioned beneath said second plug release means, said plug pass indicator means further characterized by a wheel shaft rotatably mounted in said housing and having one end projecting outside of said housing and the opposite end extending into said hollow interior of said housing; a gear fixedly attached to said one end of said wheel shaft; a mount plate fixedly carried by said housing and a guide fixedly attached to said mount plate; a mount bar slidably carried by said mount plate and supported by said guide in slidable relationship; a rack cooperating with said gear and fixedly carried by said mount bar, whereby rotation of said wheel shaft and said gear causes extension of said rack and said mount bar with respect to said mount plate, said guide and said housing; and a wheel fixedly attached to said opposite end of said wheel shaft for engagement with said first cementing plug and said second cementing plug and rotation of said wheel shaft and said gear to extend said rack when said first cementing plug and said second cementing plug are sequentially released from said first plug release mechanism and said second plug release mechanism.

13. A cementing plug container assembly for cementing casing in a well comprising:

(a) a housing having a hollow interior and a connector on one end for joining said housing to the well;

(b) conduit means extending through said housing and into said hollow interior for injecting concrete and fluids into said hollow interior of said housing;

(c) a first plug release means carried by said housing and extending through said housing into said hollow interior, and a first cementing plug supported in said hollow interior by said first plug release means and a second plug release means carried by said housing and positioned beneath said first plug release means and extending through said housing into said hollow interior and a second cementing plug supported in said hollow interior by said second plug release means, said first plug release means and said second plug release means are further characterized by a cam lock having a projecting finger and provided with a cam lock aperture; a release cam having a cam slot for engagement with said projecting finger of said cam lock, and a cam lock release pin in registration with said cam lock aperture; a release shaft having one end fixedly carried by said release cam and extending through said housing and into said hollow interior; a release cam fixedly attached to the end of said release shaft opposite said one end and positioned in said hollow interior of said housing for supporting a cementing plug; and an air cylinder having a piston rod in engagement with said cam lock, whereby said cam lock is selectively moved outwardly against said lock release pin to first disengage said projecting finger from said cam slot and then displace said lock release pin and rotate said release cam, said release shaft, and said release arm to allow said first cementing plug and said second cementing plug to sequentially drop from a first position to a second position in said hollow interior; and (d) a plug pass indicator means characterized by a wheel shaft rotatably mounted in said housing and having one end projecting outside of said housing and the opposite end extending into said hollow interior of said housing; a gear fixedly attached to said one end of said wheel shaft; a mount plate fixedly carried by said housing and a guide fixedly attached to said mount plate; a mount bar slidably carried by said mount plate and supported by said guide in slidable relationship; a rack cooperating with said gear and fixedly carried by said mount bar, whereby rotation of said wheel shaft and said gear causes extension of said rack and said mount bar with respect to said mount plate, said guide and said housing; and a wheel fixedly attached to said opposite end of said wheel shaft for engagement with said first cementing plug and said second cementing plug and rotation of said wheel shaft and said gear to extend said rack when said first cementing plug and said second cementing plug are sequentially released from said first plug release mechanism and said second plug release mechanism.

14. A plug pass indicator mechanism for indicating the passage of a cementing plug through a cementing plug container assembly housing, comprising a wheel shaft rotatably mounted in said housing and having one end projecting outside of said housing and the opposite end extending onto said hollow interior of said housing; a gear fixedly attached to said one end of said wheel shaft; a mount plate fixedly carried by said housing and a guide fixedly attached to said mount plate; a mount bar slidably carried by said mount plate and supported by said guide in slidable relationship; a rack cooperating with said gear and fixedly carried by said mount bar, whereby rotation of said wheel shaft and said gear causes extension of said rack and said mount bar with respect to said mount plate, said guide and said housing; and a wheel fixedly attached to said opposite end of said wheel shaft for engagement with cementing plugs and rotation of said wheel shaft and said gear to extend said rack when the cementing plugs are sequentially released from said first plug release mechanism and said second plug release mechanism.

15. A method for cementing casing in a well using at least one cementing plug and a cementing plug container having a removable dome and attached to the casing, comprising the steps of:

(a) providing the cementing plug container with a plug release means characterized by an air cylinder and a release arm means cooperating with the air cylinder and extending inside the cementing plug container to support the cementing plug in a first position in the cementing plug container, and a plug pass indicator means in cooperation with the cementing plug container, the plug pass indicator means having a rotatable star wheel means positioned inside the cementing plug container and located beneath the cementing plug and partially in the path of the cementing plug, to register the passage of the cementing plug from the first position to a second position in the cementing plug container;

(b) removing the dome, placing the cementing plug on the release arm means in the first position in the cementing plug container, and replacing the dome;

(c) introducing cement into the cementing plug container at a point beneath the cementing plug and forcing the cement through the casing to cement the casing in the well;

(d) introducing compressed air into the air cylinder to cause the release arm means to rotate downwardly and allow the cementing plug to drop from the first position to the second position in the cementing plug container to a point above the casing; and (e) introducing a fluid under pressure into the cementing plug container and forcing the cementing plug from the second position in the cementing plug container through the casing.

16. A method as recited in claim 15 comprising the additional step of providing control means and control indicator means in cooperation with the air cylinder and the plug pass indicator means, respectively, for remotely introducing compressed air into the air cylinder and indicating when the cementing plug has passed the star wheel means.

17. A method for cementing casing in a well using a pair of cementing plugs and a cementing plug container having a removable dome and attached to the casing, comprising the steps of:

(a) providing the cementing plug container with a pair of plug release means positioned in stacked relationship, each of the plug release means characterized by an externally mounted air cylinder and a release arm means cooperating with the air cylinder and extending inside the cementing plug container for supporting the cementing plugs, respectively;

(b) providing the cementing plug container with a plug pass indicator means in cooperation with the cementing plug container, the plug pass indicator means having a star wheel means rotatably located inside the cementing plug container and having an indicator means on the exterior of the cementing plug container, the star wheel means positioned partially in the path of the cementing plugs to rotate and cause the indicator means to register sequential passage of the cementing plugs through the cementing plug container;

(c) removing the dome from the cementing plug container, placing a bottom cementing plug in a first position on the bottom release arm means, and a top cementing plug in a second position on the top release arm means, and replacing the dome on the cementing plug container;

(d) introducing compressed air into the air cylinder cooperating with the bottom release arm means to cause the bottom release arm means to rotate downwardly and allow the bottom plug to drop from the first position to a third position inside the cementing plug container;

(e) introducing a first volume of fluid under pressure into the cementing plug container at a point beneath the top cementing plug and forcing the bottom cementing plug from the third position in the cementing plug container through the casing;

(f) introducing cement into the cementing plug container and the casing to cement the casing to the well formation;

(g) introducing compressed air into the air cylinder cooperating with the top release arm means to cause the top release arm means to rotate downwardly and allow the top plug to drop from the second position to the third position inside the cementing plug container; and (h) introducing a second volume of fluid under pressure into the cementing plug container and forcing the top cementing plug from the third position in the cementing plug container through the casing.

18. A method as recited in claim 17 comprising the additional step of providing control means and control indicator means in cooperation with the air cylinders and the plug pass indicator means for remotely introducing compressed air into the air cylinders and indicating when the bottom cementing plug and the top cementing plug have passed the star wheel means, respectively.

19. A plug release mechanism for dropping a cementing plug from a first position in a cementing plug container assembly housing having a hollow interior to a second position in said housing, comprising a cam lock having a projecting finger and provided with a cam lock aperture; a release cam having a cam slot for engagement with said projecting finger of said cam lock and a cam lock release pin in registration with said cam lock aperture; a release shaft having one end fixedly carried by said release cam and extending through said housing and into said hollow interior; a release arm fixedly attached to the end of said release shaft opposite said one end and positioned in said hollow interior of said housing for supporting a cementing plug; and an air cylinder having a piston rod in engagement with said cam locking whereby said cam lock is selectively moved outwardly against said lock release pin to first disengage said projecting finger from said cam slot and then displace said lock release pin and rotate said release cam, said release shaft, and said release arm to allow the cementing plug positioned in a first position in said hollow interior and resting on said release arm, to drop from the first position to a second position in said hollow interior.

* * * * *